US009576535B2

(12) United States Patent
Park et al.

(10) Patent No.: US 9,576,535 B2
(45) Date of Patent: Feb. 21, 2017

(54) PIXEL AND ORGANIC LIGHT EMITTING DISPLAY USING THE SAME

(71) Applicant: Samsung Display Co., Ltd., Yongin, Gyeonggi-do (KR)

(72) Inventors: Yong-Sung Park, Yongin (KR); Tak-Young Lee, Yongin (KR); Hai-Jung In, Yongin (KR); Bo-Yong Chung, Yongin (KR); Min-Hyuk Choi, Yongin (KR); Yong-Jae Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 220 days.

(21) Appl. No.: 14/148,667

(22) Filed: Jan. 6, 2014

(65) Prior Publication Data

US 2014/0198085 A1 Jul. 17, 2014

(30) Foreign Application Priority Data

Jan. 17, 2013 (KR) ..... 10-2013-0005453
Jan. 17, 2013 (KR) ..... 10-2013-0005454
Jun. 28, 2013 (KR) ..... 10-2013-0075336

(51) Int. Cl.
*G06F 3/038* (2013.01)
*G09G 3/32* (2016.01)

(52) U.S. Cl.
CPC ..... *G09G 3/3241* (2013.01); *G09G 3/3233* (2013.01); *G09G 2300/0819* (2013.01);
(Continued)

(58) Field of Classification Search
CPC ..... G09G 3/3241; G09G 3/3233; G09G 2320/0233; G09G 2360/148; G09G 2300/0861; G09G 2320/045; G09G 2310/0245;G09G 2310/0251; G09G 2300/0852; G09G 2320/043; G09G 2300/0819
See application file for complete search history.

(56) References Cited

U.S. PATENT DOCUMENTS 8,094,098 B2 1/2012 Lee
8,334,853 B2 12/2012 Kim et al.
(Continued)

FOREIGN PATENT DOCUMENTS

EP 2 146 337 A1 1/2010
EP 2 463 849 A1 6/2012
(Continued)

OTHER PUBLICATIONS

EPO Search Report dated Jul. 11, 2014, for corresponding European Patent application 14151419.0, (15 pages).
(Continued)

*Primary Examiner* — Andrew Sasinowski
*Assistant Examiner* — Gerald Oliver
(74) *Attorney, Agent, or Firm* — Lewis Roca Rothgerber Christie LLP

(57) ABSTRACT

A pixel includes an organic light emitting diode, a first driver and a second driver. The second driver controls an amount of current supplied from a first power source to the organic light emitting diode, corresponding to a previous data signal. The first driver stores a current data signal supplied from a data line and supplies the previous data signal to the second driver. In the pixel, the second driver includes a sixth transistor coupled between an initialization power source and a first node coupled to a gate electrode of a first transistor, the sixth transistor being configured to turn on when a first control signal is supplied; and a seventh transistor coupled between the first power source and a second node commonly coupled to the first and second
(Continued)

drivers, the seventh transistor being configured to turn on when the first control signal is supplied.

39 Claims, 11 Drawing Sheets

(52) U.S. Cl.
CPC ..... *G09G 2300/0852* (2013.01); *G09G 2300/0861* (2013.01); *G09G 2310/0245* (2013.01); *G09G 2310/0251* (2013.01); *G09G 2320/0233* (2013.01); *G09G 2320/043* (2013.01); *G09G 2320/045* (2013.01); *G09G 2360/148* (2013.01)

(56) References Cited

U.S. PATENT DOCUMENTS

| | | | | |
|---|---|---|---|---|
| 9,262,962 | B2 | 2/2016 | Kim et al. | |
| 2005/0017934 | A1 | 1/2005 | Chung et al. | |
| 2008/0111804 | A1 | 5/2008 | Choi et al. | |
| 2008/0211796 | A1 | 9/2008 | Kim | |
| 2008/0224965 | A1 | 9/2008 | Kim | |
| 2009/0027310 | A1 | 1/2009 | Kim | |
| 2009/0146987 | A1 | 6/2009 | Kim et al. | |
| 2009/0243498 | A1 | 10/2009 | Childs et al. | |
| 2010/0013816 | A1* | 1/2010 | Kwak ..... | G09G 3/3233 345/211 |
| 2010/0045650 | A1 | 2/2010 | Fish et al. | |
| 2010/0053045 | A1 | 3/2010 | Fish et al. | |
| 2010/0220093 | A1* | 9/2010 | Choi ..... | G09G 3/3233 345/213 |
| 2011/0090200 | A1 | 4/2011 | Choi et al. | |
| 2011/0157126 | A1* | 6/2011 | Chung ..... | G09G 3/3233 345/211 |
| 2011/0279484 | A1 | 11/2011 | Han et al. | |
| 2012/0026143 | A1* | 2/2012 | Jang ..... | G09G 5/00 345/211 |
| 2012/0113077 | A1 | 5/2012 | Kang | |

FOREIGN PATENT DOCUMENTS

| | | | |
|---|---|---|---|
| KR | 10-2005-0005646 | A | 1/2005 |
| KR | 10-0741973 | B1 | 7/2007 |
| KR | 10-0815756 | B1 | 3/2008 |
| KR | 10-0836432 | B1 | 6/2008 |
| KR | 10-0865396 | B1 | 10/2008 |
| KR | 10-0873076 81 | | 12/2008 |
| KR | 10-0873078 | B1 | 12/2008 |
| KR | 10-0911969 | B1 | 8/2009 |
| KR | 10-2009-0104319 | A | 10/2009 |
| KR | 10-1022118 | B1 | 3/2011 |
| KR | 10-2012-0048294 | A | 5/2012 |

OTHER PUBLICATIONS

EPO Search Report dated Mar. 25, 2014, for corresponding European Patent application 14151419.0, (7 pages).

Korean Patent Abstracts No. 10-2007-0019463 A for Patent No. KR 10-0741973 B1, 1 page.

* cited by examiner

PIXEL AND ORGANIC LIGHT EMITTING DISPLAY USING THE SAME

CROSS-REFERENCE TO RELATED APPLICATIONS

This application claims priority to and the benefit of Korean Patent Application Nos. 10-2013-0005453 and 10-2013-0005454, both filed on Jan. 17, 2013, and Korean Patent Application No. 10-2013-0075336 filed on Jun. 28, 2013, in the Korean Intellectual Property Office, the entire contents of all three of which are incorporated herein by reference in their entirety.

BACKGROUND

1. Field

Embodiments of the present invention relate to a pixel and an organic light emitting display using the same.

2. Description of the Related Art

With the recent advances in information technologies, the importance of a display as a mode of presenting information has increased. Accordingly, flat panel displays (FPDs) such as a liquid crystal display (LCD), an organic light emitting display and a plasma display panel (PDP) are being increasingly used.

An organic light emitting display displays images using organic light emitting diodes that emit light through recombination of electrons and holes. The organic light emitting display has a fast response speed and has low power consumption.

SUMMARY

Embodiments of the present invention provide a pixel and an organic light emitting display using the same, which can be driven at a low frequency.

Embodiments of the present invention also provide a pixel and an organic light emitting display using the same, which can improve display quality by compensating for degradation of an organic light emitting diode.

According to an embodiment of the present invention, there is provided a pixel including: an organic light emitting diode; a second driver configured to control an amount of current supplied from a first power source to the organic light emitting diode, corresponding to a previous data signal; and a first driver configured to store a current data signal supplied from a data line and supply the previous data signal to the second driver, wherein the second driver includes: a sixth transistor coupled between an initialization power source and a first node coupled to a gate electrode of a first transistor, the sixth transistor being configured to turn on when a first control signal is supplied; and a seventh transistor coupled between the first power source and a second node commonly coupled to the first and second drivers, the seventh transistor being configured to turn on when the first control signal is supplied.

The initialization power source may be set to a voltage lower than the data signal supplied to the data line.

The first driver may include a second transistor coupled between the data line and a third node, the second transistor being configured to turn on when a scan signal is supplied to a scan line; a third transistor coupled between the third and second nodes, the third transistor being configured to turn on when a second control signal is supplied; and a second capacitor coupled between the third node and the initialization power source.

The third and sixth transistors may have turn-on periods not overlapped with each other.

The second transistor may have a turn-on period not overlapped with those of the third and sixth transistors.

The second driver may include an eighth transistor coupled between the first power source and the second node coupled to a first electrode of the first transistor, the eighth transistor being configured to turn off when an emission control signal is supplied and to turn on otherwise; a fifth transistor coupled between the first node and a second electrode of the first transistor, the fifth transistor being configured to turn on when the second control signal is supplied; a ninth transistor coupled between the second electrode of the first transistor and an anode electrode of the organic light emitting diode, the ninth transistor being configured to turn off when the emission control signal is supplied and to turn on otherwise; and a first capacitor coupled between the first node and the first power source.

The eighth transistor may have a turn-on period not overlapped with those of the fifth and sixth transistors.

The fifth and sixth transistors may have turn-on periods not overlapped with each other.

The second driver may further include a fourth transistor coupled between the anode electrode of the organic light emitting diode and the initialization power source, the fourth transistor being configured to turn on when the first control signal is supplied.

The second driver may further include a fourth transistor coupled between the anode electrode of the organic light emitting diode and the initialization power source, the fourth transistor being configured to turn on when the second control signal is supplied.

The second driver may further include a fourth transistor positioned between the anode electrode of the organic light emitting diode and a second control line to which the second control signal is supplied, the fourth transistor having a gate electrode coupled to the second control line.

The second driver may further include a photodiode coupled in parallel to the first capacitor between the first node and the first power source.

The photodiode may control the increment of the voltage at the first node, corresponding to the luminance of the organic light emitting diode.

The photodiode may control the increment of the voltage at the first node, in proportion to the luminance of the organic light emitting diode.

The second driver may further include a third capacitor coupled between the anode electrode of the organic light emitting diode and the second node.

According to an embodiment of the present invention, there is provided an organic light emitting display, including: a control driver configured to supply a first control signal to a first control line, and to supply a second control signal to a second control line during a first period in one frame; a scan driver configured to supply an emission control line to an emission control line during the first period, a second period and a third period in the one frame, and progressively supply a scan signal to scan lines during a fourth period in the one frame; a data driver configured to supply a data signal to data lines, in synchronization with the scan signal, during the fourth period in the one frame; and pixels positioned in an area defined by the scan lines and the data lines, the pixels storing a current data signal during a period in which the pixels emit light, corresponding to a previous data signal.

The previous data signal may be a data signal supplied in a previous frame, and the current data signal may be a data signal supplied in a current frame.

The scan driver may concurrently supply a scan signal to the scan lines during the third period.

The data driver may supply a reset voltage to the data lines during the third period.

The reset voltage may be set to a voltage in a voltage range of the data signal.

Each pixel may control an amount of current flowing from a first power source to a second power source via an organic light emitting diode, corresponding to the previous data signal.

The first power source may be set to a first voltage during the fourth period, and may be set to a second voltage different from the first voltage during the first to third periods.

The second voltage may be a voltage lower than the first voltage.

Each pixel may include an organic light emitting diode; a second driver configured according to an amount of current supplied from the first power source to the organic light emitting diode, corresponding to the previous data signal; and a first driver configured to store the current data signal, and to supply the previous data signal to the second driver.

The first driver may include a second transistor coupled between a corresponding one of the data lines and a third node, the second transistor being configured to turn on when a scan signal is supplied to a corresponding one of the scan lines; a third transistor coupled between the third node and a second node commonly coupled to the first and second drivers, the third transistor being configured to turn on when the second control signal is supplied; and a second capacitor coupled between the third node and an initialization power source.

The second driver may include a first transistor configured to have a first electrode coupled to the first power source via the second node commonly coupled to the first and second drivers, the first transistor having a gate electrode coupled to a first node; a fifth transistor coupled between a second electrode of the first transistor and the first node, the fifth transistor being configured to turn on when the second control signal is supplied; a sixth transistor coupled between the first node and the initialization power source, the sixth transistor being configured to turn on when the first control signal is supplied; a seventh transistor coupled between the second node and the first power source, the seventh transistor being configured to turn on when the first control signal is supplied; an eighth transistor coupled between the second node and the first power source, the eighth transistor being configured to turn off when the emission control signal is supplied and to turn on otherwise; and a ninth transistor coupled between the second electrode of the first transistor and an anode electrode of the organic light emitting diode, the ninth transistor being configured to turn off when the emission control signal is supplied and to turn on otherwise.

The initialization power source may be set to a voltage lower than the data signal.

The second driver may further include a fourth transistor coupled between the anode electrode of the organic light emitting diode and the initialization power source, the fourth transistor being configured to turn on when the first control signal is supplied.

The second driver may further include a fourth transistor coupled between the anode electrode of the organic light emitting diode and the initialization power source, the fourth transistor being configured to turn on when the second control signal is supplied.

The second driver may further include a fourth transistor positioned between the anode electrode of the organic light emitting diode and the second control line, the fourth transistor having a gate electrode coupled to the second control line.

The second driver may further include a photodiode coupled in parallel with the first capacitor between the first node and the first power source.

The photodiode may control the increment of the voltage at the first node, corresponding to the luminance of the organic light emitting diode.

According to an embodiment of the present invention, there is provided a pixel including an organic light emitting diode; a second driver configured to control an amount of current supplied from a first power source to the organic light emitting diode, corresponding to a previous data signal; and a first driver configured to store a current data signal supplied from a data line and to supply the previous data signal to the second driver, wherein the second driver comprises: a fourth transistor coupled between an anode electrode of the organic light emitting diode and an initialization power source, the fourth transistor being configured to turn on when a first control signal is supplied; and a seventh transistor coupled between the first power source and a second node commonly coupled to the first and second drivers, the seventh transistor being configured to turn on when the first control signal is supplied.

The first driver may further include a second transistor coupled between the data line and a third node, the second transistor being configured to turn on when a scan signal is supplied to a scan line; a third transistor coupled between the third and second nodes, the third transistor being configured to turn on when a second control signal is supplied; and a second capacitor coupled between the third node and the initialization power source.

The second driver may further include a fifth transistor coupled between a first node coupled to a gate electrode of a first transistor and a second electrode of the first transistor, the fifth transistor being configured to turn on when a second control signal is supplied; a sixth transistor coupled between the initialization power source and the first node, the sixth transistor being configured to turn on when the first control signal is supplied; an eighth transistor coupled between the first power source and the second node, the second node being coupled to a first electrode of the first transistor, the eighth transistor being configured to turn off when an emission control signal is supplied and to turn on otherwise; a ninth transistor coupled between the second electrode of the first transistor and the anode electrode of the organic light emitting diode, the ninth transistor being configured to turn off when the emission control signal is supplied and to turn on otherwise; and a first capacitor coupled between the first node and the first power source.

The eighth transistor may have a turn-on period not overlapped with those of the fifth and sixth transistors.

The fifth and sixth transistors may have turn-on periods not overlapped with each other.

The photodiode may control the increment of the voltage at the first node, in proportion to the luminance of the organic light emitting diode.

The second driver may further include a third capacitor coupled between the anode electrode of the organic light emitting diode and the second node.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
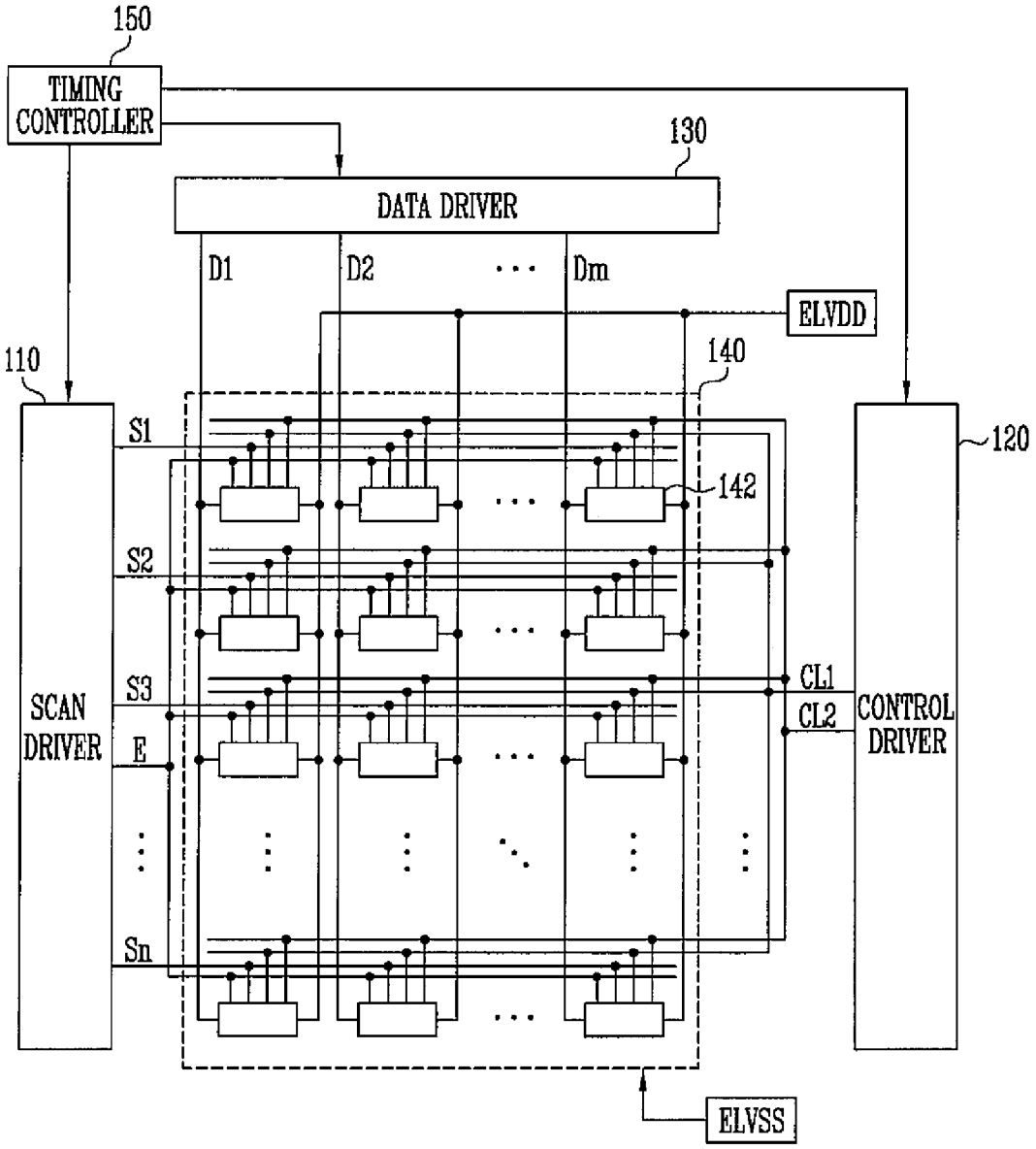
FIG. 1 is a diagram illustrating an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention are omitted for clarity. Also, like reference numerals refer to like elements throughout.

FIG. 1 is a diagram illustrating an organic light emitting display according to an embodiment of the present invention.

Referring to FIG. 1, the organic light emitting display according to this embodiment includes pixels positioned in an area defined by scan lines S1 to Sn and data lines D1 to Dm, a display unit 140 including the pixels 142, a scan driver 110 for driving the scan lines S1 to Sn and an emission control line E, a control driver 120 for driving first and second control lines CL1 and CL2, a data driver 130 for driving the data lines D1 to Dm, and a timing controller 150 for controlling the scan driver 110, the control driver 120 and the data driver 130.

Figure 3:
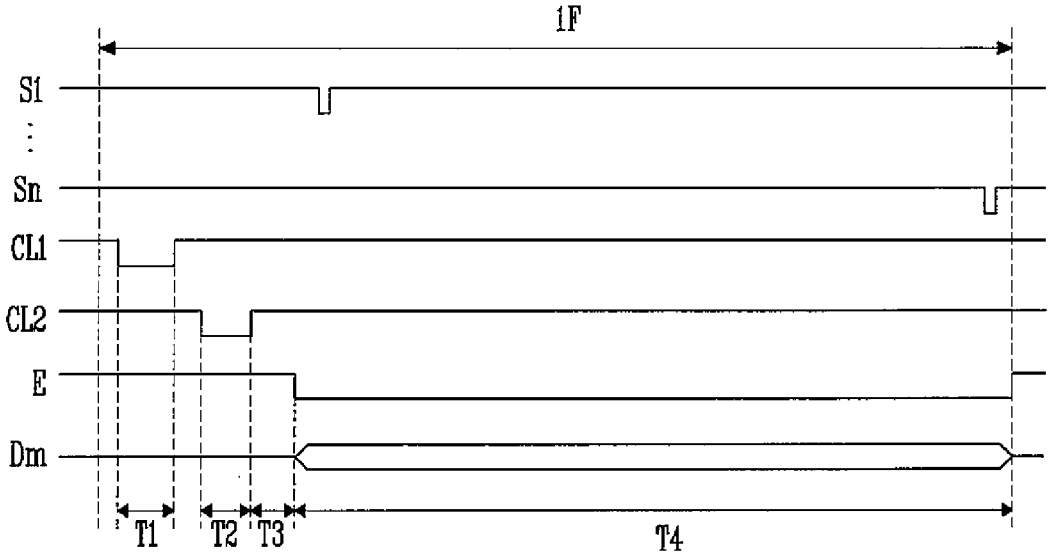
FIG. 3 is a waveform diagram illustrating a driving method according to an embodiment of the present invention.
Figure 4:
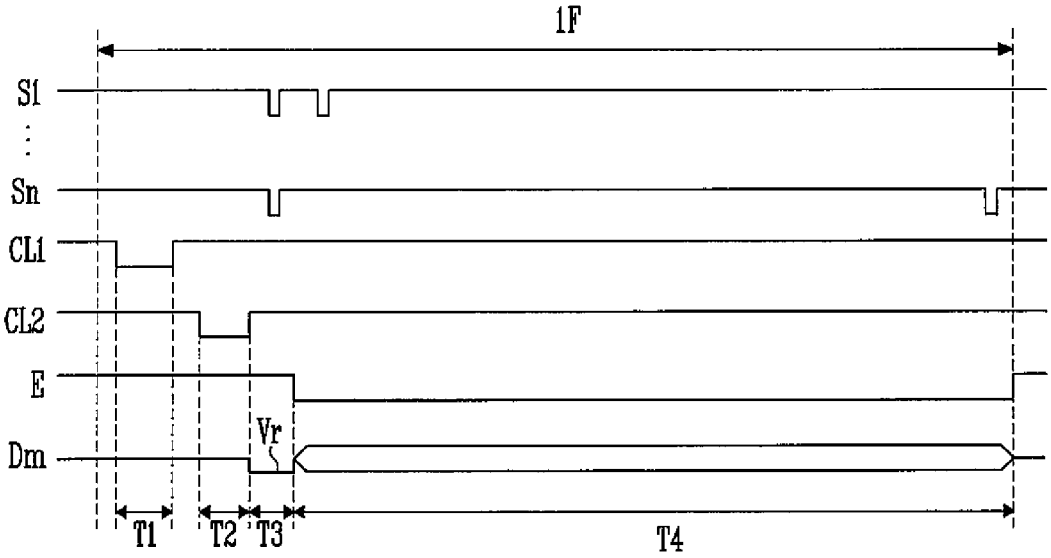
FIG. 4 is a waveform diagram illustrating a driving method according to another embodiment of the present invention.

The scan driver 110 supplies a scan signal to the scan lines S1 to Sn. For example, the scan driver 110, as shown in FIG. 3, may progressively supply the scan signal to the scan lines S1 to Sn during a fourth period T4 in one frame 1F. The scan driver 110, as shown in FIG. 4, may concurrently (e.g., simultaneously) supply the scan signal to the scan lines S1 to Sn during a third period T3 in the one frame 1F.

The scan driver 110 supplies an emission control signal to the emission control line E commonly coupled to the pixels 142. For example, the scan driver 110 may supply the emission control signal to the emission control line E during the other periods T1, T2 and T3 except the fourth period T4 in the one frame 1F. Here, the scan signal supplied from the scan driver 110 is set to a voltage (e.g., a low voltage) at which transistors included in the pixels 142 are turned on, and the emission control signal is set to a voltage (e.g., a high voltage) at which the transistors are turned off.

The control driver 120 supplies a first control signal to the first control line CL1 commonly coupled to the pixels 142, and supplies a second control signal to the second control line CL2 commonly coupled to the pixels 142. Here, the first and second control signals CL1 and CL2 are not overlapped with each other. For example, the control driver 120 supplies the first control signal to the first control line CL1 during a first period T1 in the one frame 1F, and supplies the second control signal to the second control line CL2 during a second period T2 in the one frame 1F. Here, the first and second control signals are set to a voltage (e.g., a low voltage) at which the transistors can be turned on.

The data driver 130 supplies a data signal to the data lines D1 to Dm so in synchronization with the scan signal supplied to the scan lines S1 to Sn during the fourth period T4 in the one frame 1F. Here, the data driver 130 may alternately supply left and right data signals every frame for the purpose of 3D driving. Additionally, the data driver 130 may supply a reset voltage Vr to the data lines D1 to Dm during the third period T3 in the one frame 1F. Here, the reset voltage Vr may be set to a voltage in a voltage range of the data signal.

The timing controller 150 controls the scan driver 110, the control driver 120 and the data driver 130, corresponding to a synchronization signal supplied from the outside of the organic light emitting display.

The display unit 140 includes the pixels 142 positioned in the area defined by the scan lines S1 to Sn and the data lines D1 to Dm. The pixels 142, during the fourth period T4, charge a data signal (current data signal) of a current frame and concurrently (e.g., simultaneously) emit light corresponding to a data signal (e.g., a previous data signal) of a previous frame. To this end, the pixels 142, during the fourth period T4, control an amount of current flowing from a first power source ELVDD to a second power source ELVSS via organic light emitting diodes.

Although it has been illustrated in FIG. 1 that, for convenience of illustration, the emission control line E is coupled to the scan driver 110, and the control lines CL1 and CL2 are coupled to the control driver 120, the present invention is not limited thereto. In practice, the emission control line E and the control lines CL1 and CL2 may be coupled to various drivers. For example, the emission control line E and the control lines CL1 and CL2 may be commonly coupled to the scan driver 110.

Figure 2:
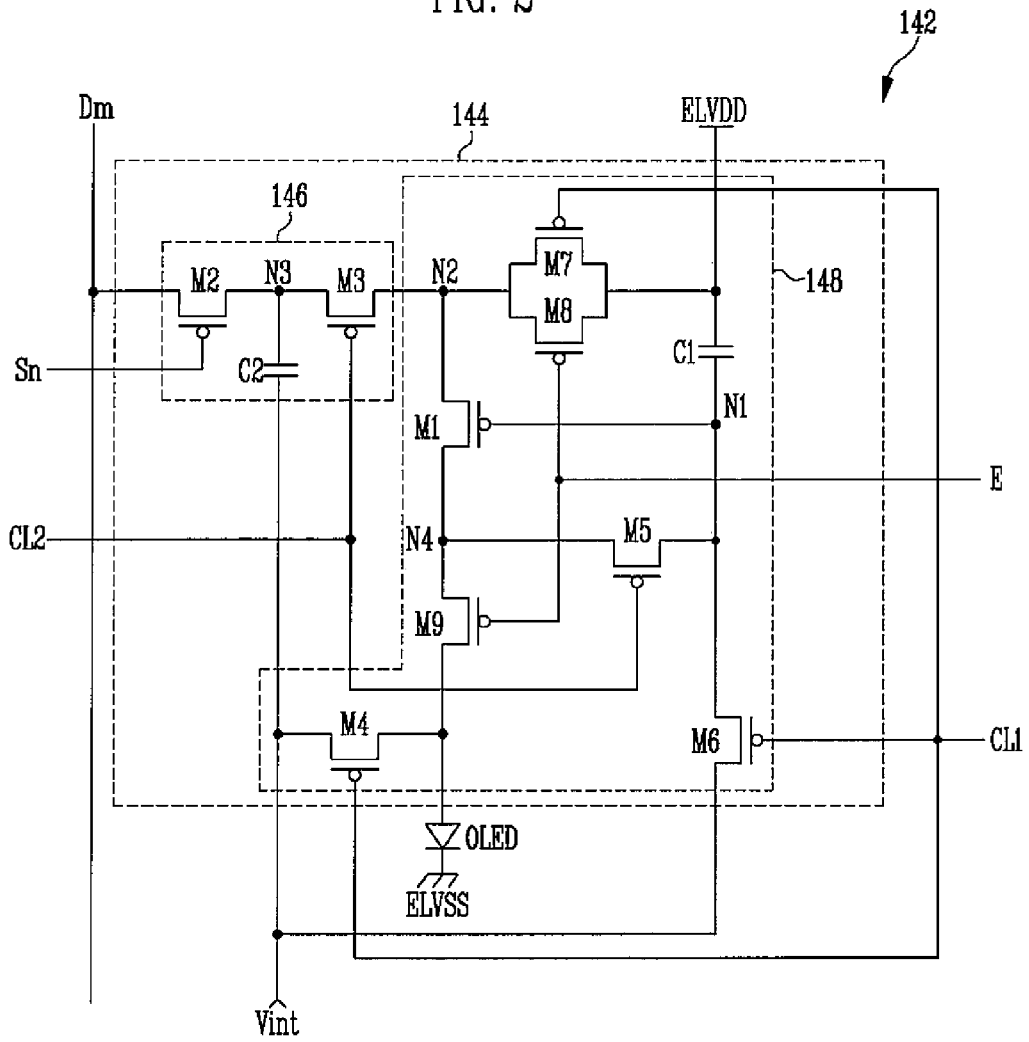
FIG. 2 is a circuit diagram illustrating a pixel according to a first embodiment of the present invention.

FIG. 2 is a circuit diagram illustrating a pixel according to a first embodiment of the present invention. For convenience of illustration, a pixel coupled to an m-th data line Dm and an n-th scan line Sn will be shown in FIG. 2.

Referring to FIG. 2, the pixel 142 according to this embodiment includes an organic light emitting diode OLED and a pixel circuit 144 that controls an amount of current supplied to the organic light emitting diode OLED.

An anode electrode of the organic light emitting diode OLED is coupled to the pixel circuit 144, and a cathode electrode of the organic light emitting diode OLED is coupled to the second power source ELVSS. The organic light emitting diode OLED generates light (e.g., light having a predetermined luminance) corresponding to an amount of current supplied from the pixel circuit 144. The second power source ELVSS is set to a voltage lower than that of the first power source ELVDD so that a current can flow through the organic light emitting diode OLED.

The pixel circuit 144 includes a first driver 146 for storing the current data signal, and a second driver 148 for controlling an amount of the current supplied to the organic light emitting diode OLED, corresponding to the previous data signal.

The first driver 146 stores the current data signal supplied from the data line Dm and concurrently (e.g., simultaneously) supplies the previous data signal stored in the previous frame to the second driver 148. To this end, the first driver 146 includes a second transistor M2, a third transistor M3 and a second capacitor C2.

A first electrode of the second transistor M2 is coupled to the data line Dm, and a second electrode of the second transistor M2 is coupled to a third node N3. A gate electrode of the second transistor M2 is coupled to the scan line Sn. The second transistor M2 is turned on when the scan signal is supplied to the scan line Sn, to supply the data signal from the data line Dm to the third node N3.

A first electrode of the third transistor M3 is coupled to the third node N3, and a second electrode of the third transistor M3 is coupled to the second driver 148 (e.g., at a second node N2). A gate electrode of the third transistor M3 is coupled to the second control line CL2. The third transistor M3 is turned on when the second control signal is supplied to the second control line CL2, to allow the third and second nodes N3 and N2 to be electrically coupled to each other.

The second capacitor C2 is coupled between the third node N3 and a fixed voltage source (e.g., an initialization power source Vint). The second capacitor C2 charges a voltage corresponding to the current data signal during a period in which the second transistor M2 is turned on.

The second driver 148 charges a voltage corresponding to the previous data signal supplied from the first driver 146, and controls an amount of current flowing from the first power source ELVDD to the second power source ELVSS via the organic light emitting diode OLED, corresponding to the charged voltage. To this end, the second driver 148 includes a first transistor M1, fourth to ninth transistors M4 to M9, and a first capacitor C1.

A first electrode of the first transistor (e.g., a driving transistor) M1 is coupled to the second node N2, and a second electrode of the first transistor M1 is coupled to a fourth node N4. A gate electrode of the first transistor M1 is coupled to a first node N1. The first transistor M1 controls an amount of current supplied to the organic light emitting diode OLED, corresponding to a voltage applied to the first node N1.

A first electrode of the fourth transistor M4 is coupled to the anode electrode of the organic light emitting diode OLED, and a second electrode of the fourth transistor M4 is coupled to the initialization power source Vint. A gate electrode of the fourth transistor M4 is coupled to the first control line CL1. The fourth transistor M4 is turned on when the first control signal is supplied to the first control line CL1, to supply the voltage of the initialization power source Vint to the anode electrode of the organic, light emitting diode OLED. Here, the initialization power source Vint is set to a voltage lower than the data signal. For example, the initialization power source Vint may be set to a voltage lower than that obtained by subtracting the absolute threshold voltage of the first transistor M1 from the data signal having the lowest voltage.

A first electrode of the fifth transistor M5 is coupled to the fourth node N4, and a second electrode of the fifth transistor M5 is coupled to the first node N1. A gate electrode of the fifth transistor M5 is coupled to the second control line CL2. The fifth transistor M5 is turned on when the second control signal is supplied to the second control line CL2, to allow the first and fourth nodes N1 and N4 to be electrically coupled to each other. When the first and fourth nodes N1 to N4 are electrically coupled to each other, the first transistor M1 is diode-coupled.

A first electrode of the sixth transistor M6 is coupled to the first node N1, and a second electrode of the sixth transistor M6 is coupled to the initialization power source Vint. A gate electrode of the sixth transistor M6 is coupled to the first control line CL1. The sixth transistor M6 is turned on when the first control signal is supplied to the first control line CL1, to supply the voltage of the initialization power source Vint to the first node N1.

A first electrode of the seventh transistor M7 is coupled to the first power source ELVDD, and a second electrode of the seventh transistor M7 is coupled to the second node N2. A gate electrode of the seventh transistor M7 is coupled to the first control line CL1. The seventh transistor M7 is turned on when the first control signal is supplied to the first control line CL1, to supply the voltage of the first power source ELVDD to the second node N2.

A first electrode of the eighth transistor M8 is coupled to the first power source ELVDD, and a second electrode of the eighth transistor M8 is coupled to the second node N2. A gate electrode of the eighth transistor M8 is coupled to the emission control line E. The eighth transistor M8 is turned off when the emission control signal is supplied to the emission control line E, and is turned on when the emission control signal is not supplied.

A first electrode of the ninth transistor M9 is coupled to the fourth node N4, and a second electrode of the ninth transistor M9 is coupled to the anode electrode of the organic light emitting diode OLED. A gate electrode of the ninth transistor M9 is coupled to the emission control line E. The ninth transistor M9 is turned off when the emission control signal is supplied to the emission control line E, and is turned on when the emission control signal is not supplied.

The first capacitor C1 is coupled between the first power source ELVDD and the first node N1. The first capacitor C1 charges a voltage corresponding to the previous data signal and the threshold voltage of the first transistor M1.

FIG. 3 is a waveform diagram illustrating a driving method according to an embodiment of the present invention.

Referring to FIG. 3, one frame according to this embodiment is divided into first to fourth periods T1 to T4.

First, the emission control signal is supplied during the first to third periods T1 to T3, and the emission control signal is not supplied during the fourth period T4. When the emission control signal is supplied, the eighth and ninth transistors M8 and M9 are turned off. When the ninth transistor M9 is turned off, the first transistor M1 and the organic light emitting diode OLED are electrically decoupled from each other, and accordingly, the organic light emitting diode OLED is set in the non-emission state during the first to third periods T1 to T3.

The first control signal is supplied to the first control line CL1 during the first period T1. When the first control signal is supplied to the first control line CL1, the fourth, sixth and seventh transistors M4, M6 and M7 are turned on.

When the fourth transistor M4 is turned on, the voltage of the initialization power source Vint is supplied to the anode electrode of the organic light emitting diode OLED. When the voltage of the initialization power source Vint is supplied to the anode electrode of the organic light emitting diode OLED, the voltage charged in a parasitic capacitor (not shown) equivalently formed in the organic light emitting diode OLED is discharged.

When the sixth transistor M6 is turned on, the voltage of the initialization power source Vint is supplied to the first node N1. When the seventh transistor M7 is turned on, the voltage of the first power source ELVDD is supplied to the second node N2. Here, the initialization power source Vint is set to a voltage lower than the data signal, and hence the first transistor M1 is set in an on-bias state during the first period T1. Then, the first transistor M1 is initialized in the on-bias state, thereby improving display quality.

The second control signal is supplied to the second control line CL2 during the second period T2. When the second control signal is supplied to the second control line CL2, the third and fifth transistors M3 and M5 are turned on. When the fifth transistor M5 is turned on, the first transistor M1 is diode-coupled. When the third transistor M3 is turned on, the voltage of the previous data signal stored in the second capacitor C2 is supplied to the second node N2. In this case, the voltage at the first node N1 is initialized as the voltage of the initialization power source Vint, lower than the data signal, and hence the first transistor M1 is turned on.

When the first transistor M1 is turned on, the voltage of the data signal, applied to the second node N2, is supplied to the first node N1 via the diode-coupled first transistor M1. In this case, the first capacitor C1 stores a voltage corresponding to the data signal and the threshold voltage of the first transistor M1.

The supply of the emission control signal to the emission control line E is maintained during the third period T3.

The supply of the emission control signal to the emission control line E is stopped during the fourth period T4. When the supply of the emission control signal to the emission control line E is stopped, the eighth and ninth transistors M8 and M9 are turned on. When the eighth transistor M8 is turned on, the first power source ELVDD and the second node N2 are electrically coupled to each other. When the ninth transistor M9 is turned on, the fourth node N4 and the organic light emitting diode OLED are electrically coupled to each other. Then, the first transistor M1 controls an amount of the current flowing from the first power source ELVDD to the second power source ELVSS via the organic light emitting diode OLED, corresponding to the voltage applied to the first node N1. In this case, the organic light emitting diode OLED generates light (e.g., light having a predetermined luminance) corresponding to the amount of current supplied thereto.

The scan signal is progressively supplied to the scan lines S1 to Sn during the fourth period T4. When the scan signal is progressively supplied to the scan lines S1 to Sn, the second transistor M2 included in each pixel 142 for each horizontal line is turned on. When the second transistor M2 is turned on, the current data signal from a data line (any one of D1 to Dm) is supplied to the third node N3 included in each pixel 142. In this case, the second capacitor C2 charges a voltage corresponding to the current data signal. In practice, according to embodiments of the present invention, images are displayed by repeating the aforementioned procedure.

FIG. 4 is a waveform diagram illustrating a driving method according to another embodiment of the present invention. In reference to FIG. 4, detailed descriptions of components that are substantially identical to those of FIG. 3 will be omitted.

Referring to FIG. 4, during the third period T3 in the driving method according to this embodiment, the scan signal is concurrently (e.g., simultaneously) supplied to the scan lines S1 to Sn, and the reset voltage Vr is supplied to the data lines D1 to Dm in synchronization with the scan signal.

When the scan signal is supplied to the n-th scan line Sn during the third period T3, the second transistor M2 is turned on. When the second transistor M2 is turned on, the reset voltage Vr is supplied to the third node N3. That is, the voltage at the third node N3 included in each pixel 142 is initialized as the reset voltage Vr during the third period T3.

Subsequently, the scan signal is progressively supplied to the scan lines S1 to Sn during the fourth period T4. When the scan signal is supplied to the n-th scan line Sn, the second transistor M2 is turned on. When the second transistor M2 is turned on, the current data signal from the data line Dm is supplied to the third node N3. In this case, the second capacitor C2 charges a voltage corresponding to the current data signal.

Here, the third node N3 is initialized with the reset voltage Vr during the third period T3, and hence a uniform voltage corresponding to the current data signal may be charged in the second capacitor C2 during the fourth period T4.

For example, the voltage at the third node N3 included in each pixel 142 is set corresponding to the voltage of the previous data signal after the second period T2. That is, the voltages at the third nodes N3 included in the respective pixels 142 are set different from one another, corresponding to the previous data signal. Thus, in a case where the voltage at the third node N3 is not initialized, the voltage of the current data signal stored in the second capacitor C2 is altered by the voltage of the previous data signal, and accordingly, a crosstalk phenomenon may occur.

Figure 5:
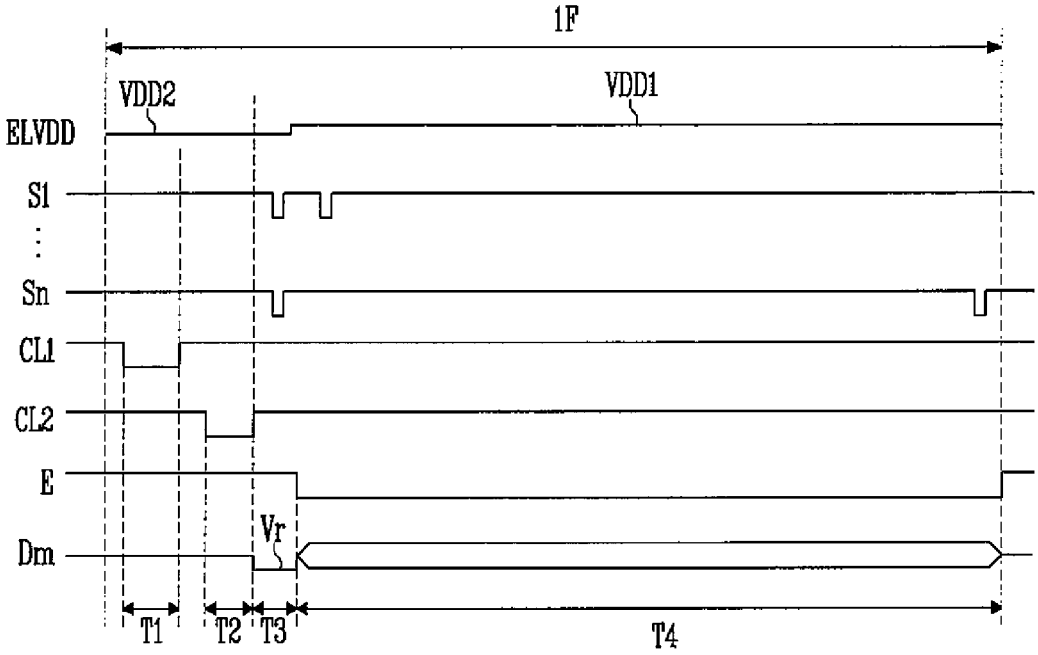
FIG. 5 is a waveform diagram illustrating a driving method according to still another embodiment of the present invention.

FIG. 5 is a waveform diagram illustrating a driving method according to still another embodiment of the present invention. In reference to FIG. 5, detailed descriptions of components that are substantially identical to those of FIG. 4 will be omitted.

Referring to FIG. 5, in the driving method according to this embodiment, the voltage of the first power source ELVDD is changed. That is, the first power source ELVDD is set to a first voltage VDD1 during the fourth period T4 in which the pixels 142 emit light, and is set to a second voltage VDD2 lower than the first voltage VDD1 during the first to third periods T1 to T3 in which the pixels 142 do not emit light. Here, the second voltage VDD2 is set to a voltage higher than that of the initialization power source Vint so that the first transistor M1 is set in the on-bias state during the first period T1.

For example, the first power source ELVDD is set to the second voltage VDD2 during the first to third periods T1 to T3. The voltage of the first power source ELVDD is raised to the first voltage VDD1 during the fourth period T4.

When the voltage of the first power source ELVDD is raised to the first voltage VDD1 during the fourth period T4, the voltage at the first node N1, which is set in a floating state, is also raised. When the voltage at the first node N1 is raised as described above, it is possible to improve the ability to express (or represent) black.

For example, the first capacitor C1 is charged using the voltage charged in the second capacitor C2 during the second period T2. In this case, the voltage charged in the first capacitor C1 is set to a voltage lower than a desired voltage, and therefore, the organic light emitting diode OLED emits a small amount of light when the black is expressed (or represented). Accordingly, in this embodiment, the voltage of the first power source ELVDD and the voltage at the first node N1 corresponding thereto are raised during the fourth period T4, so that it is possible to prevent the organic light emitting diode OLED from emitting a small amount of light when the black is expressed (or represented).

Figure 6:
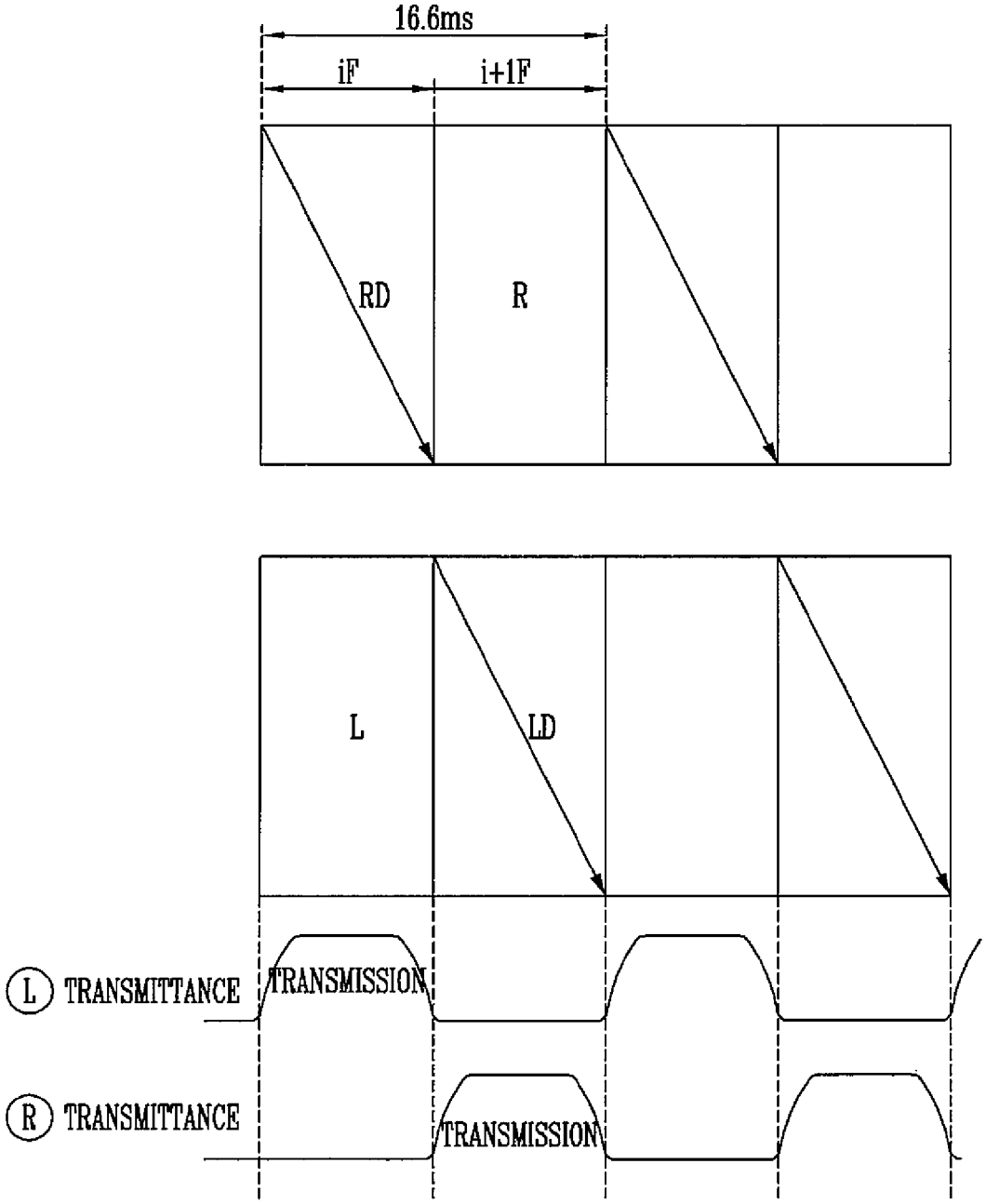
FIG. 6 is a diagram illustrating an embodiment of a driving frequency in 3D driving.

FIG. 6 is a diagram illustrating an embodiment of a driving frequency in 3D driving.

Referring to FIG. 6, the organic light emitting display according to embodiments of the present invention receives a data signal during an emission period. That is, the pixels 142 store a voltage corresponding to the right (or left) data signal during a period in which an image corresponding to the left (or right) data signal. Thus, in embodiments of the present invention, a 3D image can be implemented at a driving frequency of 120 Hz. In FIG. 6, RD represents a right data signal, and LD represents a left data signal. In addition, R represents emission corresponding to the right data signal, and L represents emission corresponding to the left data signal.

Figure 7:
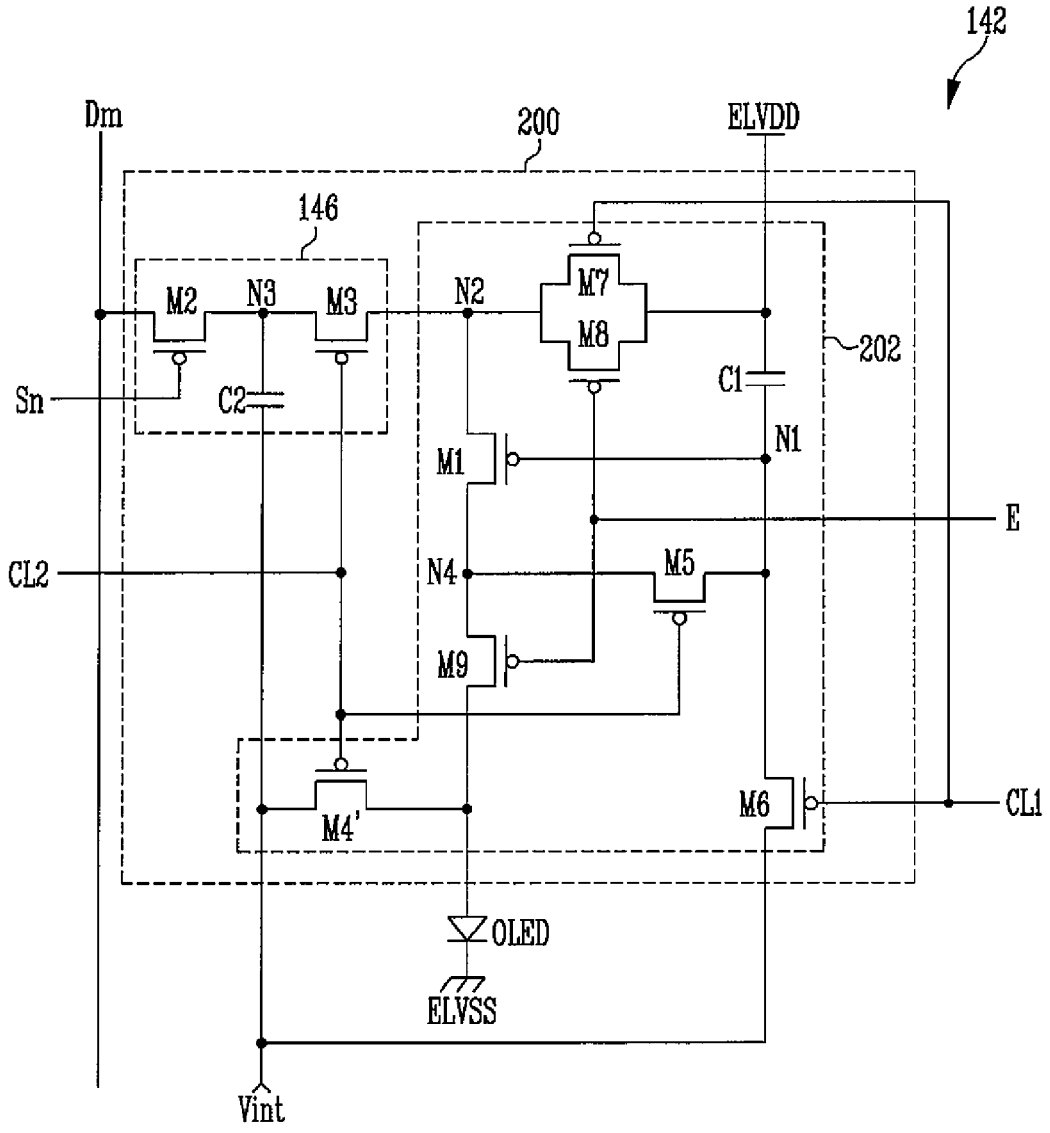
FIG. 7 is a circuit diagram illustrating a pixel according to a second embodiment of the present invention.

FIG. 7 is a circuit diagram illustrating a pixel according to a second embodiment of the present invention. In FIG. 7, components that are substantially identical to those of FIG. 2 are designated by like reference numerals, and their detailed descriptions will be omitted.

Referring to FIG. 7, the pixel 142 according to this embodiment includes a pixel circuit 200 and the organic light emitting diode OLED.

The pixel circuit 200 includes the first driver 146 for storing the current data signal, and a second driver 202 for controlling an amount of the current supplied to the organic light emitting diode OLED, corresponding to the previous data signal.

The second driver 202 includes a fourth transistor M4' coupled between the anode electrode of the organic light emitting diode OLED and the initialization power source Vint. A gate electrode of the fourth transistor M4' is coupled to the second control line CL2. The fourth transistor M4' is turned on when the second control signal is supplied to the second control line CL2, to supply the voltage of the initialization power source Vint to the anode electrode of the organic light emitting diode OLED. The operating process of the pixel according to this embodiment, except the fourth transistor M4', is substantially the same as that of the pixel according to the first embodiment, and therefore, its detailed description will be omitted.

Figure 8:
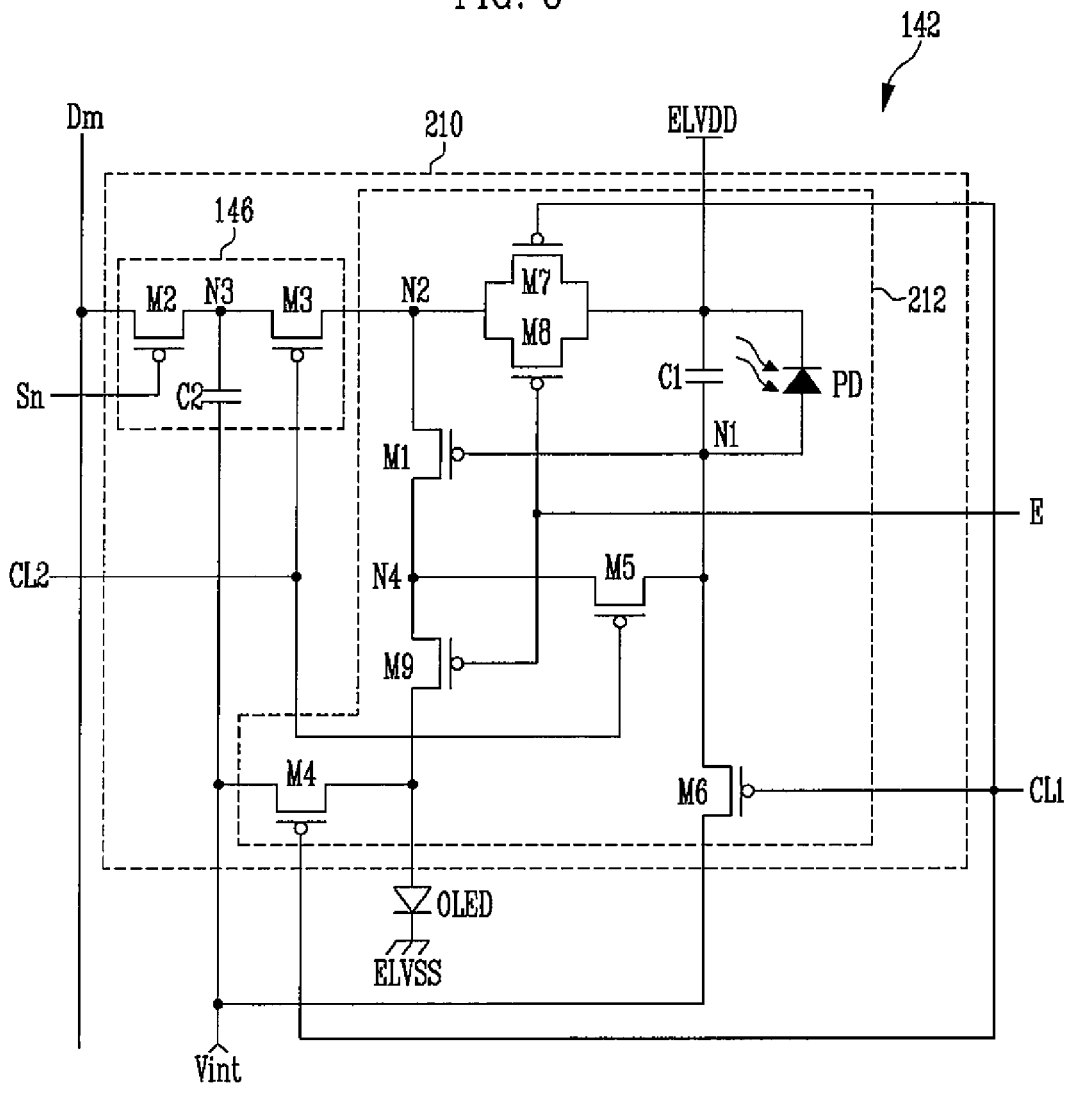
FIG. 8 is a circuit diagram illustrating a pixel according to a third embodiment of the present invention.
Figure 9:
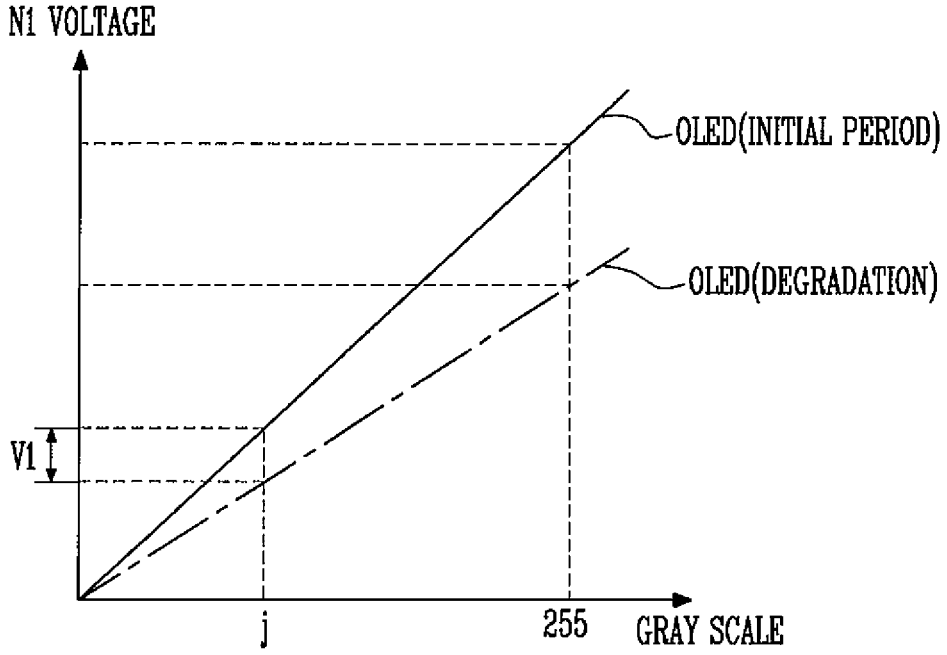
FIG. 9 is a graph illustrating the increment of the voltage at a first node, corresponding to degradation of an organic light emitting diode.

FIG. 8 is a circuit diagram illustrating a pixel according to a third embodiment of the present invention. In FIG. 8, components that are substantially identical to those of FIG. 2 are designated by like reference numerals, and their detailed descriptions will be omitted.

Referring to FIG. 8, the pixel 142 according to this embodiment includes a pixel circuit 210 and the organic light emitting diode OLED.

The pixel circuit 210 includes the first driver 146 for storing the current data signal, and a second driver 212 for controlling an amount of the current supplied to the organic light emitting diode OLED, corresponding to the previous data signal.

The second driver 212 includes a photodiode PD coupled in parallel to the first capacitor C1 between the first power source ELVDD and the first node N1. The photodiode PD controls an amount of current supplied from the first power source ELVDD to the first node N1, i.e., the voltage at the first node N1, corresponding to the brightness of the organic light emitting diode OLED. In practice, the photodiode PD controls the voltage at the first node N1 so that the degradation of the organic light emitting diode OLED can be compensated for.

The operating process of the pixel will be described. During the fourth period T4, the photodiode PD controls an amount of current flowing from the first power source ELVDD to the first node N1, i.e., an increment of the voltage at the first node N1, in proportion to the luminance of the organic light emitting diode OLED. In other words, the photodiode PD controls the voltage at the first node N1 to be increased as the luminance of the organic light emitting diode OLED increases.

For example, as the organic light emitting diode OLED is degraded, the organic light emitting diode OLED generates light with a low luminance, corresponding to the same gray level. Thus, the voltage at the first node N1 is changed by the photodiode PD, corresponding to the degradation of the organic light emitting diode OLED. That is, although a data signal with the same gray level is supplied, an increment of the voltage at the first node N1 is changed by the photodiode PD.

In a case where the organic light emitting diode OLED emits light, corresponding to a specific gray level j (j is a natural number), the increment of the voltage at the first node N1 when the organic light emitting diode OLED is degraded is set lower by a first voltage V1 than that of the voltage at the first node N1 when the organic light emitting diode OLED is not degraded. That is, in the described embodiment of the present invention, the increment of the voltage at the first node N1 is set low as the organic light emitting diode OLED is degraded, and accordingly, it is possible to compensate for a decrease in luminance, caused by the degradation of the organic light emitting diode OLED.

In practice, according to embodiments of the present invention, an amount of current supplied to the organic light emitting diode OLED may be represented as shown in Equation 1.

$$I_{oled} = \frac{1}{2}\mu C_{ox}\frac{W}{L}(ELVDD - V_{N1} - |V_{th}|)^2 \qquad \text{Equation 1}$$

$$I_{oled} = \frac{1}{2}\mu C_{ox}\frac{W}{L}\left(ELVDD - \frac{C2Vdata + C1Vint}{C2 + C1} - \Delta V_{PD}\right)^2$$

In Equation 1, μ denotes the mobility of the first transistor M1, $C_{ox}$ denotes the gate capacitance of the first transistor, $V_{th}$ denotes the threshold voltage of the first transistor M1, and W and L denote the channel width/length ratio of the first transistor M1. In addition, Vdata denotes the voltage of the data signal, and $\Delta V_{PD}$ denotes a variation in voltage, caused by the photodiode PD. Referring to Equation 1, an amount of the current supplied to the organic light emitting diode OLED is determined by the voltage of the data signal and the variation in voltage, caused by the photodiode PD. In the variation in voltage, caused by the photodiode PD, an increment of the voltage at the first node N1 is set low as the organic light emitting diode OLED is degraded. Accordingly, it is possible to compensate for a decrease in luminance of the organic light emitting diode OLED.

The operating process of the pixel 142 according to this embodiment, except that the photodiode PD is added so that the degradation of the organic light emitting diode OLED is compensated for, is substantially identical to that of the pixel in the first embodiment shown in FIG. 2. In practice, the pixel 142 according to this embodiment can be driven with the driving waveforms shown in FIGS. 3 to 5.

Figure 10:
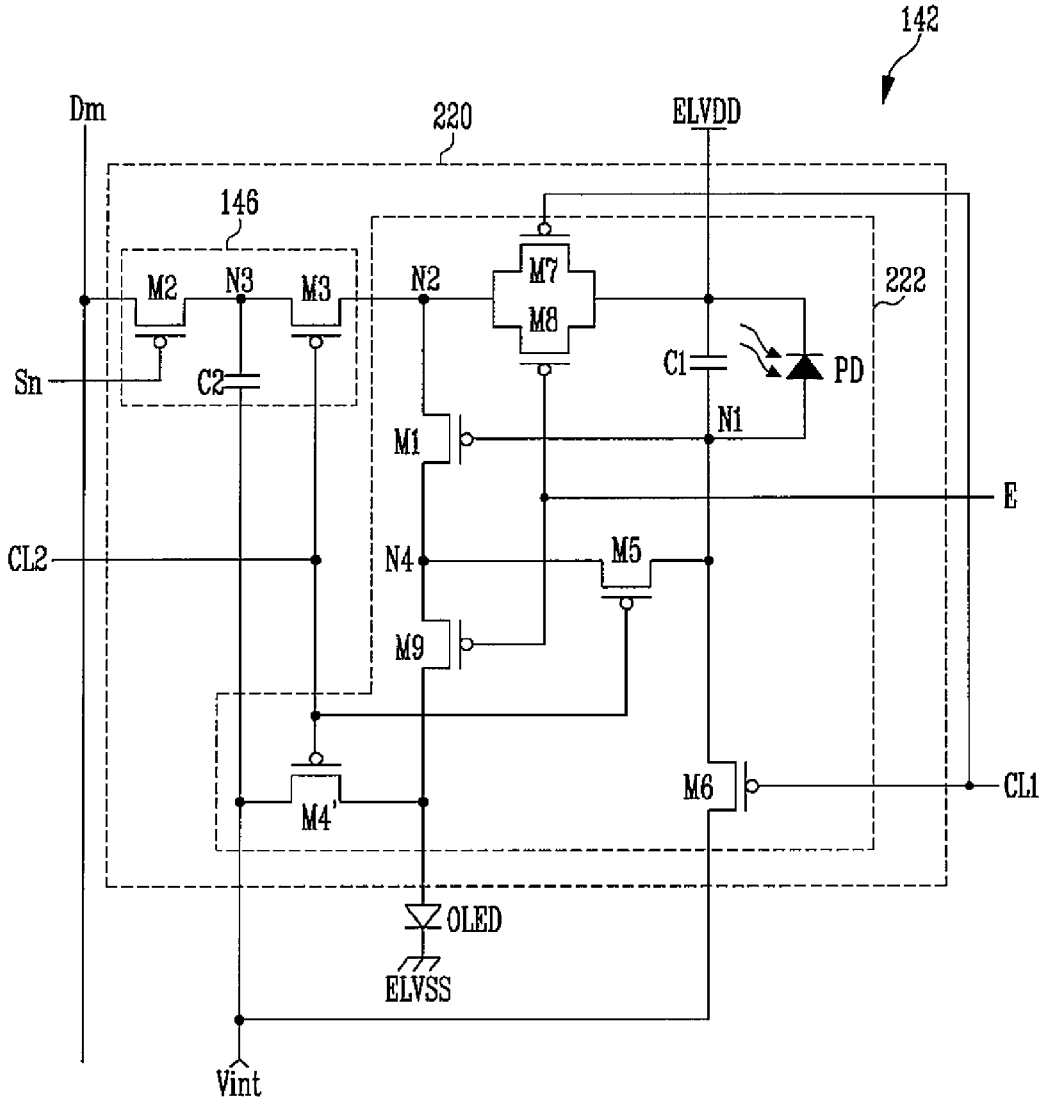
FIG. 10 is a circuit diagram illustrating a pixel according to a fourth embodiment of the present invention.

FIG. 10 is a circuit diagram illustrating a pixel according to a fourth embodiment of the present invention. In FIG. 10, components that are substantially identical to those of FIG. 7 are designated by like reference numerals, and their detailed descriptions will be omitted.

Referring to FIG. 10, the pixel 142 according to this embodiment includes a pixel circuit 220 and the organic light emitting diode OLED.

The pixel circuit 220 includes the first driver 146 for storing the current data signal, and a second driver 222 for controlling an amount of the current supplied to the organic light emitting diode OLED, corresponding to the previous data signal.

The second driver 222 includes a photodiode PD coupled in parallel to the first capacitor C1 between the first power source ELVDD and the first node N1. The photodiode PD controls an amount of current supplied from the first power source ELVDD to the first node N1, i.e., the voltage at the first node N1, corresponding to the brightness of the organic light emitting diode OLED. In practice, the photodiode PD controls the voltage at the first node N1 so that the degradation of the organic light emitting diode OLED can be compensated for.

Figure 11:
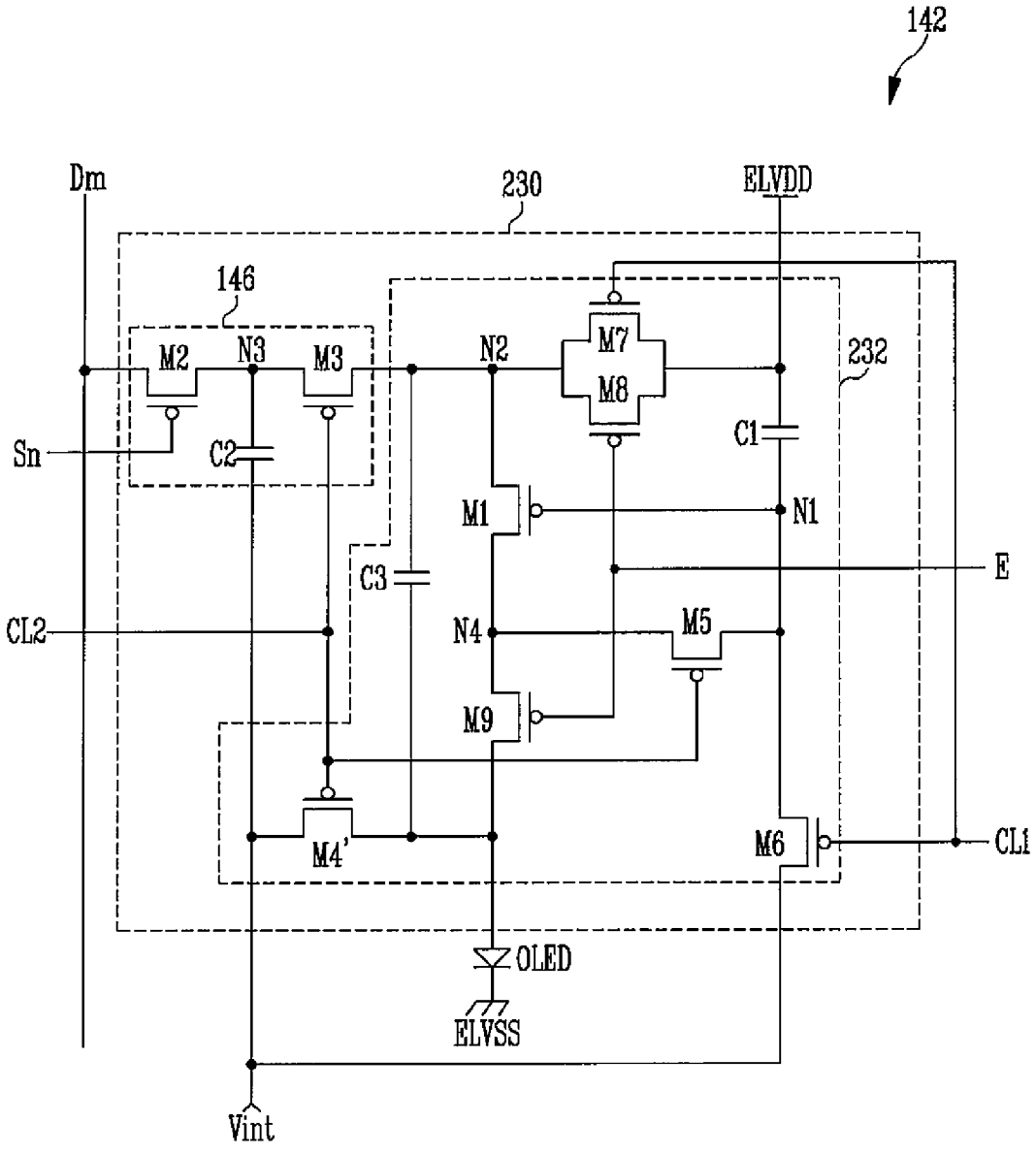
FIG. 11 is a circuit diagram illustrating a pixel according to a fifth embodiment of the present invention.

FIG. 11 is a circuit diagram illustrating a pixel according to a fifth embodiment of the present invention. In FIG. 11, components that are substantially identical to those of FIG. 7 are designated by like reference numerals, and their detailed descriptions will be omitted.

Referring to FIG. 11, the pixel 142 according to this embodiment includes a pixel circuit 230 and the organic light emitting diode OLED.

The pixel circuit 230 includes the first driver 146 for storing the current data signal, and a second driver 232 for controlling an amount of the current supplied to the organic light emitting diode OLED, corresponding to the previous data signal.

The second driver 232 includes a third capacitor C3 coupled between the second node N2 and the anode electrode of the organic light emitting diode OLED. The third capacitor C3 controls the voltage at the second node N2, corresponding to the voltage at the anode electrode of the organic light emitting diode OLED. For example, the third capacitor C3 controls the voltage at the second node N2 so that the degradation of the organic light emitting diode OLED is compensated for.

The pixel 142 according to this embodiment can be driven with any one of the driving waveforms shown in FIGS. 3 to 5.

The operating process of the pixel will be described in conjunction with the driving waveform of FIG. 3. The emission control signal is supplied to the emission control line E during the first to third periods T1 to T3, and the emission control signal is not supplied to the emission control line E during the fourth period T4. When the emission control signal is supplied to the emission control line E, the eighth and ninth transistors M8 and M9 are turned off. Then, the first transistor M1 and the organic light emitting diode OLED are electrically decoupled from each other, and accordingly, the organic light emitting diode OLED is set in the non-emission state during the first to third periods T1 to T3. When the ninth transistor M9 is turned off, the anode electrode of the organic light emitting diode OLED is set to a voltage (e.g., a predetermined voltage) Voled.

The first control signal is supplied to the first control line CL1 during the first period T1 so that the sixth and seventh transistors M6 and M7 are turned on. When the sixth transistor M6 is turned on, the voltage of the initialization power source Vint is supplied to the first node N1. When the seventh transistor M7 is turned on, the voltage of the first power source ELVDD is supplied to the second node N2. In this case, the first transistor M1 is initialized in an on-bias state.

The second control signal is supplied to the second control line CL2 during the second period T2. When the second control signal is supplied to the second control line CL2, the third, fourth and fifth transistors M3, M4' and M5 are turned on.

When the fifth transistor M5 is turned on, the first transistor M1 is diode-coupled. When the third transistor M3 is turned on, the voltage of the previous data signal stored in the second capacitor C2 is supplied to the second node N2. When the fourth transistor M4' is turned on, the voltage Voled at the anode electrode of the organic light emitting diode OLED is dropped to the voltage of the initialization power source Vint. In this case, the voltage at the second node N2 is dropped, corresponding to a decrement of the voltage at the anode electrode of the organic light emitting diode OLED, by coupling of the third capacitor C3.

When the voltage of the previous data signal is supplied to the second node N2, the first transistor M1 is turned on. When the first transistor M1 is turned on, the voltage applied to the second node N2 is supplied to the first node N1 via the diode-coupled first transistor M1. In this case, the first capacitor C1 stores a voltage corresponding to the previous data signal, the threshold voltage of the first transistor M1 and the degradation of the organic light emitting diode OLED.

For example, when the fourth transistor M4' is turned on, the voltage at the anode electrode of the organic light emitting diode OLED is changed as shown in Equation 2.

$$\Delta V\text{oled} = V\text{oled} - (V\text{int}) \qquad \text{Equation 2}$$

In Equation 2, Voled denotes the voltage at the anode electrode of the organic light emitting diode OLED, applied during the first period T1. Referring to Equation 2, the voltage at the anode electrode of the organic light emitting diode OLED during the second period T2 is dropped from the voltage Voled applied during the first period T1 to the voltage of the initialization power source Vint.

In this case, the variation (ΔVoled) in the voltage at the anode electrode of the organic light emitting diode OLED is determined by the degradation of the organic light emitting diode OLED. In practice, as the organic light emitting diode OLED is degraded, the resistance of the organic light emitting diode OLED is increased. Accordingly, as the organic light emitting diode OLED is degraded, the variation (ΔVoled) in the voltage at the anode electrode of the organic light emitting diode OLED is increased.

For example, the resistance of the organic light emitting diode OLED is increased corresponding to the degradation of the organic light emitting diode OLED. When the resistance of the organic light emitting diode OLED is increased, the voltage Voled at the anode electrode of the organic light emitting diode OLED, which is applied during the first period T1, is increased. Thus, as the organic light emitting diode OLED is degraded, a decrement of the voltage at the second node N2 is increased, and accordingly, the degradation of the organic light emitting diode OLED can be compensated for. In other words, when the voltage at the second node N2 is dropped, the voltage at the first node N1 is also dropped. Accordingly, as the organic light emitting diode OLED is degraded, an amount of the current supplied to the organic light emitting diode OLED is increased, thereby compensating for the degradation of the organic light emitting diode OLED.

The supply of the emission control signal to the emission control line E is maintained during the third period T3.

The supply of the emission control signal to the emission control line En is stopped during the fourth period T4, so that the eighth and ninth transistors M8 and M9 are turned on. When the eighth transistor M8 is turned on, the first power source ELVDD and the second node N2 are electrically coupled to each other. When the ninth transistor M9 is turned on, the fourth node N4 and the anode electrode of the organic light emitting diode OLED are electrically connected to each other. Then, the first transistor M1 controls an amount of the current flowing from the first power source ELVDD to the second power source ELVSS via the organic light emitting diode OLED, corresponding to the voltage applied to the first node N1. In this case, the organic light emitting diode OLED generates light (e.g., light with a predetermined luminance) corresponding to an amount of current supplied thereto.

The scan signal is progressively supplied to the scan lines S1 to Sn during the fourth period T4. When the scan signal is progressively supplied to the scan lines S1 to Sn, the second transistor M2 included in each pixel 142 is turned on for each horizontal line. When the second transistor M2 is turned on, the current data signal from a data line (any one of D1 to Dm) is supplied to the third node N3 included in each pixel 142. In this case, the second capacitor C2 charges a voltage corresponding to the current data signal. In practice, in embodiments according to the present invention, images are displayed by repeating the aforementioned procedure.

Figure 12:
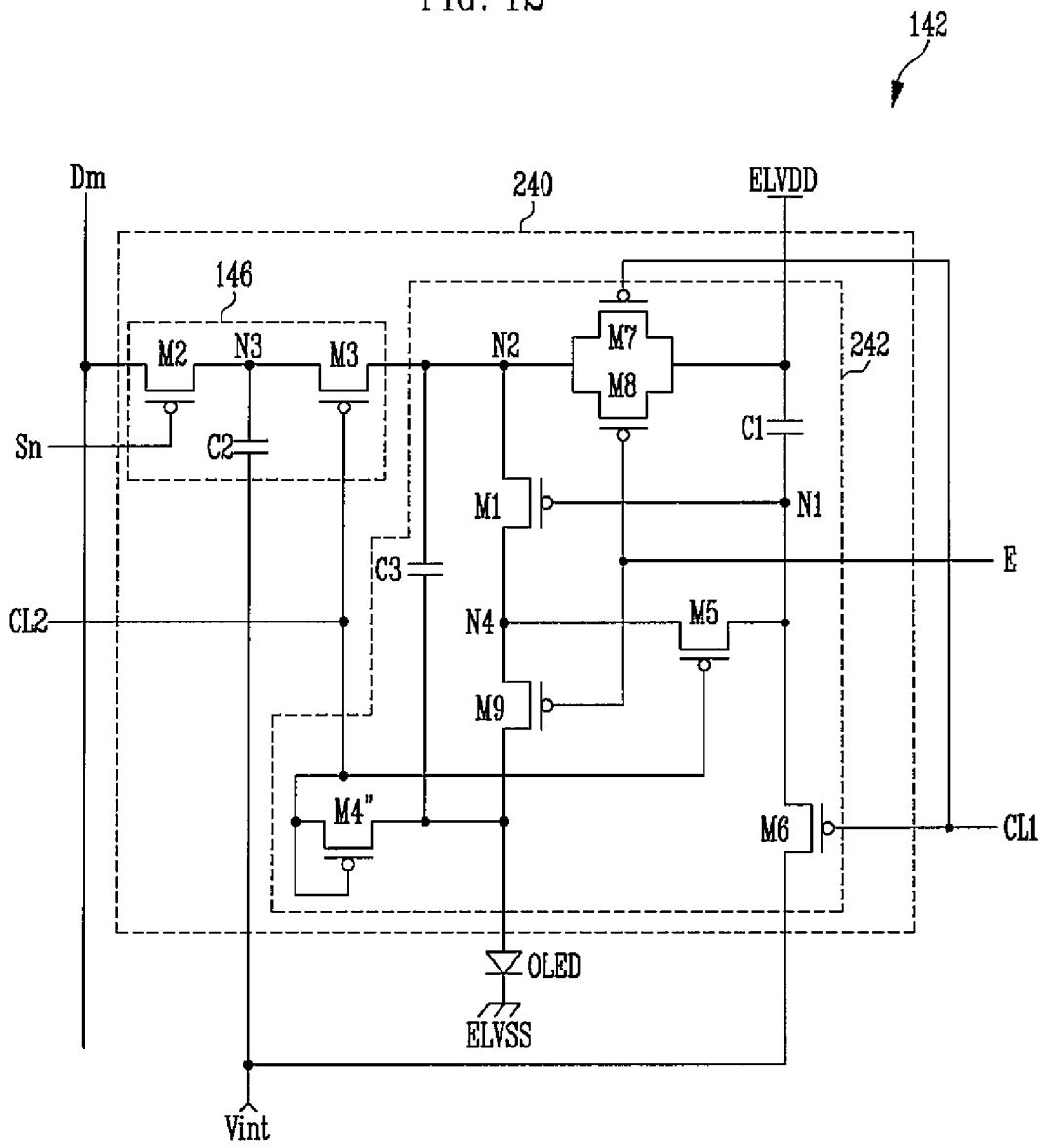
FIG. 12 is a circuit diagram illustrating a pixel according to a sixth embodiment of the present invention.

FIG. 12 is a circuit diagram illustrating a pixel according to a sixth embodiment of the present invention. In FIG. 12, components that are substantially identical to those of FIG. 11 are designated by like reference numerals, and their detailed descriptions will be omitted.

Referring to FIG. 12, the pixel according to this embodiment includes a pixel circuit 240 and the organic light emitting diode OLED.

The pixel circuit 240 includes the first driver 146 for storing the current data signal, and a second driver 242 for controlling an amount of the current supplied to the organic light emitting diode OLED, corresponding to the previous data signal.

The second driver 242 includes a fourth transistor M4" coupled between the second control line CL2 and the organic light emitting diode OLED. A gate electrode of the fourth transistor M4" is coupled to the second control line CL2. That is, the fourth transistor M4" is diode-coupled. The fourth transistor M4" allows the voltage at the anode electrode of the organic light emitting diode OLED to be dropped to approximately the voltage of the second control signal when the second control signal is supplied to the second control line CL2.

That is, the operating process of the pixel according to this embodiment, except that the voltage Voled at the anode electrode of the organic light emitting diode OLED is dropped to the voltage of the second control signal other than that of the initialization power source Vint, is substantially identical to that of the pixel according to the fifth embodiment shown in FIG. 11. Therefore, its detailed description will be omitted.

Although it has been described in embodiments according to the present invention that the transistors are shown as PMOS transistors for convenience of illustration, the present invention is not limited thereto. In other words, the transistors may be formed as NMOS transistors.

In embodiments of the present invention, the organic light emitting diode OLED may generate red, green and blue light, corresponding to an amount of current supplied from the driving transistor, or may generate white light, corresponding to the amount of the current supplied from the driving transistor. In a case where the organic light emitting diode OLED generates white light, a color image is implemented using a separate color filter or the like.

By way of summation and review, an organic light emitting display includes a plurality of pixels arranged in a matrix form at crossing regions of a plurality of data lines, a plurality of scan lines and a plurality of power lines. Each pixel generally includes an organic light emitting diode, two or more transistors including a driving transistor, and one or more capacitors.

In order to implement a 3D image, the organic light emitting display includes four frames during a period of 16.6 ms. A left image is displayed in a first frame among the four frames, and a right image is displayed in a third frame among the four frames. In addition, a black image is displayed in second and fourth frames among the four frames.

In shutter glasses, a left lens receives light during the first frame, and a right lens receives light during the third frame. In this case, a user wearing the shutter glasses recognizes, as a 3D image, an image supplied through the shutter glasses. The left and right lenses switch from either receiving light to not receiving light or from not receiving light to receiving light while the black image is being displayed during the second and fourth frames, and thus it is possible to prevent the occurrence of a crosstalk phenomenon.

However, in the related art organic light emitting display, the four frames are included in the period of 16.6 ms, and accordingly, the organic light emitting display is driven at a driving frequency of 240 Hz. In a case where the organic light emitting display is driven at a high frequency, the power consumption of the organic light emitting display is increased, and the stability of the organic light emitting display is lowered. Further, the manufacturing cost of the organic light emitting display is increased. Since the black image is displayed during the second and fourth frames, the peak current for expressing a gray scale is increased, and accordingly, the lifespan of the organic light emitting diode is lowered.

In the pixel and the organic light emitting display using the same according to embodiments of the present invention, the pixels emit light, and concurrently (e.g., simultaneously), the data signal can be charged. Accordingly, the organic light emitting display is driven at a low frequency, thereby implementing a 3D image. Further, the driving transistor included in each pixel is initialized in an on-bias state before the data signal is supplied, thereby displaying a uniform image.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. A pixel comprising:

an organic light emitting diode;

a second driver configured to control an amount of current supplied from a first power source to the organic light emitting diode, corresponding to a previous data signal; and a first driver configured to store a current data signal supplied from a data line and to supply the previous data signal to the second driver, wherein the second driver comprises:

a sixth transistor coupled between an initialization power source and a first node coupled to a gate electrode of a first transistor, the sixth transistor being configured to turn on when a first control signal is supplied; and a seventh transistor coupled between the first power source and a second node commonly coupled to the first and second drivers, the seventh transistor being configured to turn on when the first control signal is supplied.

2. The pixel of claim 1, wherein the initialization power source has a voltage lower than that of a data signal supplied to the data line.

3. The pixel of claim 1, wherein the first driver comprises:

a second transistor coupled between the data line and a third node, the second transistor being configured to turn on when a scan signal is supplied to a scan line;

a third transistor coupled between the third and second nodes, the third transistor being configured to turn on when a second control signal is supplied; and a second capacitor coupled between the third node and the initialization power source.

4. The pixel of claim 3, wherein the third and sixth transistors have turn-on periods not overlapped with each other.

5. The pixel of claim 3, wherein the second transistor has a turn-on period not overlapped with those of the third and sixth transistors.

6. The pixel of claim 1, wherein the second driver comprises:

an eighth transistor coupled between the first power source and the second node, the second node being coupled to a first electrode of the first transistor, the eighth transistor being configured to turn off when an emission control signal is supplied and to turn on otherwise;

a fifth transistor coupled between the first node and a second electrode of the first transistor, the fifth transistor being configured to turn on when a second control signal is supplied;

a ninth transistor coupled between the second electrode of the first transistor and an anode electrode of the organic light emitting diode, the ninth transistor being configured to turn off when the emission control signal is supplied and to turn on otherwise; and a first capacitor coupled between the first node and the first power source.

7. The pixel of claim 6, wherein the eighth transistor has a turn-on period not overlapped with those of the fifth and sixth transistors.

8. The pixel of claim 6, wherein the fifth and sixth transistors have turn-on periods not overlapped with each other.

9. The pixel of claim 6, wherein the second driver further comprises a fourth transistor coupled between the anode electrode of the organic light emitting diode and the initialization power source, the fourth transistor being configured to turn on when the first control signal is supplied.

10. The pixel of claim 6, wherein the second driver further comprises a fourth transistor coupled between the anode electrode of the organic light emitting diode and the initialization power source, the fourth transistor being configured to turn on when the second control signal is supplied.

11. The pixel of claim 6, wherein the second driver further comprises a fourth transistor coupled between the anode electrode of the organic light emitting diode and a second control line to which the second control signal is supplied, the fourth transistor having a gate electrode coupled to the second control line.

12. The pixel of claim 6, wherein the second driver further comprises a photodiode coupled in parallel to the first capacitor between the first node and the first power source.

13. The pixel of claim 12, wherein the photodiode is configured to control an increment of a voltage at the first node, corresponding to a luminance of the organic light emitting diode.

14. The pixel of claim 12, wherein the photodiode is configured to control an increment of a voltage at the first node, in proportion to a luminance of the organic light emitting diode.

15. The pixel of claim 6, wherein the second driver further comprises a third capacitor coupled between the anode electrode of the organic light emitting diode and the second node.

16. An organic light emitting display comprising:

a control driver configured to supply a first control signal to a first control line during a first period in one frame, and to supply a second control signal to a second control line during a second period in the one frame;

a scan driver configured to supply an emission control signal to an emission control line during the first period, the second period, and a third period in the one frame, and to progressively supply a scan signal to scan lines during a fourth period in the one frame;

a data driver configured to supply a data signal to data lines, in synchronization with the scan signal, during the fourth period in the one frame; and pixels positioned in an area defined by the scan lines and the data lines, the pixels being configured to store a current data signal during a period in which the pixels emit light, corresponding to a previous data signal, wherein the third period is different from the first and the second period.

17. The organic light emitting display of claim 16, wherein the previous data signal is the data signal supplied in a previous frame, and the current data signal is the data signal supplied in a current frame.

18. The organic light emitting display of claim 16, wherein the scan driver is configured to supply the scan signal concurrently to the scan lines during the third period.

19. The organic light emitting display of claim 16, wherein the data driver is configured to supply a reset voltage to the data lines during the third period.

20. The organic light emitting display of claim 19, wherein the reset voltage is set to a voltage in a voltage range of the data signal.

21. The organic light emitting display of claim 16, wherein each of the pixels is configured to control an amount of current flowing from a first power source to a second power source via an organic light emitting diode, corresponding to the previous data signal.

22. The organic light emitting display of claim 21, wherein the first power source is set to a first voltage during the fourth period, and is set to a second voltage different from the first voltage during the first to third periods.

23. The organic light emitting display of claim 22, wherein the second voltage is a voltage lower than the first voltage.

24. The organic light emitting display of claim 16, wherein each of the pixels comprises:

an organic light emitting diode;

a second driver configured according to an amount of current supplied from a first power source to the organic light emitting diode, corresponding to the previous data signal; and a first driver configured to store the current data signal, and to supply the previous data signal to the second driver.

25. The organic light emitting display of claim 24, wherein the first driver comprises:

a second transistor coupled between a corresponding one of the data lines and a third node, the second transistor being configured to turn on when the scan signal is supplied to a corresponding one of the scan lines;

a third transistor coupled between the third node and a second node commonly coupled to the first and second drivers, the third transistor being configured to turn on when the second control signal is supplied; and a second capacitor coupled between the third node and an initialization power source.

26. The organic light emitting display of claim 24, wherein the second driver comprises:

a first transistor having a first electrode coupled to the first power source via a second node commonly coupled to the first and second drivers, the first transistor having a gate electrode coupled to a first node;

a fifth transistor coupled between a second electrode of the first transistor and the first node, the fifth transistor being configured to turn on when the second control signal is supplied;

a sixth transistor coupled between the first node and an initialization power source, the sixth transistor being configured to turn on when the first control signal is supplied;

a seventh transistor coupled between the second node and the first power source, the seventh transistor being configured to turn on when the first control signal is supplied;

an eighth transistor coupled between the second node and the first power source, the eighth transistor being configured to turn off when the emission control signal is supplied and to turn on otherwise; and a ninth transistor coupled between the second electrode of the first transistor and an anode electrode of the organic light emitting diode, the ninth transistor being configured to turn off when the emission control signal is supplied and to turn on otherwise.

27. The organic light emitting display of claim 26, wherein the initialization power source is set to a voltage lower than the data signal.

28. The organic light emitting display of claim 26, wherein the second driver further includes a fourth transistor coupled between the anode electrode of the organic light emitting diode and the initialization power source, the fourth transistor being configured to turn on when the first control signal is supplied.

29. The organic light emitting display of claim 26, wherein the second driver further comprises a fourth transistor coupled between the anode electrode of the organic light emitting diode and the initialization power source, the fourth transistor being configured to turn on when the second control signal is supplied.

30. The organic light emitting display of claim 26, wherein the second driver further comprises a fourth transistor positioned between the anode electrode of the organic light emitting diode and the second control line, the fourth transistor having a gate electrode coupled to the second control line.

31. The organic light emitting display of claim 26, wherein the second driver further comprises a photodiode coupled in parallel with a first capacitor between the first node and the first power source.

32. The organic light emitting display of claim 31, wherein the photodiode is configured to control an increment of a voltage at the first node, corresponding to a luminance of the organic light emitting diode.

33. The organic light emitting display of claim 31, wherein the photodiode is configured to control an increment of a voltage at the first node, in proportion to a luminance of the organic light emitting diode.

34. The organic light emitting display of claim 26, wherein the second driver further comprises a third capacitor coupled between the anode electrode of the organic light emitting diode and the second node.

35. A pixel comprising:

an organic light emitting diode;

a second driver configured to control an amount of current supplied from a first power source to the organic light emitting diode, corresponding to a previous data signal; and a first driver configured to store a current data signal supplied from a data line and to supply the previous data signal to the second driver, wherein the second driver comprises:

a fourth transistor coupled between an anode electrode of the organic light emitting diode and an initialization power source, the fourth transistor being configured to turn on when a second control signal is supplied;

a seventh transistor coupled between the first power source and a second node commonly coupled to the first and second drivers, the seventh transistor being configured to turn on when a first control signal is supplied; and a second capacitor coupled between the anode electrode of the organic light emitting diode and the second node.

36. The pixel of claim 35, wherein the first driver comprises:

a second transistor coupled between the data line and a third node, the second transistor being configured to turn on when a scan signal is supplied to a scan line;

a third transistor coupled between the third and second nodes, the third transistor being configured to turn on when the second control signal is supplied; and a third capacitor coupled between the third node and the initialization power source.

37. The pixel of claim 35, wherein the second driver comprises:

a fifth transistor coupled between a first node coupled to a gate electrode of a first transistor and a second electrode of the first transistor, the fifth transistor being configured to turn on when the second control signal is supplied;

a sixth transistor coupled between the initialization power source and the first node, the sixth transistor being configured to turn on when the first control signal is supplied;

an eighth transistor coupled between the first power source and the second node, the second node being coupled to a first electrode of the first transistor, the eighth transistor being configured to turn off when an emission control signal is supplied and to turn on otherwise;

a ninth transistor coupled between the second electrode of the first transistor and the anode electrode of the organic light emitting diode, the ninth transistor being configured to turn off when the emission control signal is supplied and to turn on otherwise; and a first capacitor coupled between the first node and the first power source.

38. The pixel of claim 37, wherein the eighth transistor has a turn-on period not overlapped with those of the fifth and sixth transistors.

39. The pixel of claim 37, wherein the fifth and sixth transistors have turn-on periods not overlapped with each other.

* * * * *